United States Patent [19]

Neueder

[11] Patent Number: 5,044,883

[45] Date of Patent: Sep. 3, 1991

[54] WATER PUMP OR THE LIKE

[76] Inventor: Ludwig Neueder, Amselstr. 9, D-8443 Furth/Bogen, Fed. Rep. of Germany

[21] Appl. No.: 410,033

[22] Filed: Sep. 21, 1989

Related U.S. Application Data

[63] Continuation of Ser. No. 873,203, Jun. 11, 1986, abandoned.

[30] Foreign Application Priority Data

Jul. 9, 1985 [DE] Fed. Rep. of Germany ..... 3524515

[51] Int. Cl.[5] ..... F04D 29/60

[52] U.S. Cl. ..... 415/214.1; 415/201; 417/360; 417/423.15

[58] Field of Search ..... 415/201, 206, 213.1, 415/214.1; 123/41.44, 41.45, 41.46; 403/350, 351, 352; 417/360, 423.15, 423.14

[56] References Cited

U.S. PATENT DOCUMENTS

| | | | |
|---|---|---|---|
| 1,612,685 | 12/1926 | Wittmann | 123/146 X |
| 2,740,388 | 4/1956 | Bennorth | 123/146 X |
| 3,244,105 | 4/1966 | La Flame | 415/215 X |
| 3,620,042 | 11/1971 | Gray | 415/219 C |
| 3,632,220 | 1/1972 | Lansinger | 415/219 CX |
| 3,723,029 | 3/1973 | Laing | 415/219 C |
| 3,778,181 | 12/1973 | McFarlin | 415/201 |
| 4,155,333 | 5/1979 | Maggiorana | 123/41.44 |
| 4,342,290 | 8/1982 | Drakulic | 415/219 C |
| 4,708,370 | 11/1987 | Todd | 285/396 X |

FOREIGN PATENT DOCUMENTS

| | | | |
|---|---|---|---|
| 2273199 | 12/1975 | France | 403/350 |

*Primary Examiner*—John T. Kwon

*Attorney, Agent, or Firm*—Kane, Dalsimer, Sullivan, Kurucz, Levy, Eisele and Richard

[57] ABSTRACT

A water pump for an internal combustion engine is provided comprising a pump holder and a pump block. The pump block includes a pump mount having a shaft passing therethrough terminating in an impeller. The pump block is mounted to the holder via a quick release, bayonet type coupling with the pump mounted sealed to the holder. A snap fitting locking ring locks the block to the holder and prevents disconnecting the coupling by blocking reverse rotation of the block relative to said holder.

3 Claims, 5 Drawing Sheets

WATER PUMP OR THE LIKE

This application is a continuation of application Ser. No. 873,203, filed June 11, 1986, now abandoned.

This invention relates to a water pump or the like, e.g., for circulating cooling water for internal combustion engines, which pump essentially consists of a pump block and a pump holder as functional elements.

In known water pumps for use in connection with internal combustion engines the pumping unit and the pump housing are made of metal and said parts are connected to each other and to the engine block by flange joints. When a replacement is necessary, the water pump, i.e., the pumping unit, is replaced. This may be required, e.g., in case of damage due to corrosion, bearing damage, leaks, etc. The complete pump housing is replaced only in very rare cases and only when such replacement is required, e.g., owing to damage due to corrosion or frost action.

A water pump having that structure has various disadvantages. For instance, the replacement of components of such water pump is complicated and time-consuming. Additional serious disadvantages reside, e.g., in a heavy weight, in a corrosion of components, in a low economy and in the need for keeping an expensive inventory in stock. Besides, the efficiency is low owing to the liquid friction of those components of the water pump which consist of metal castings.

For this reason it is an object of the invention to provide a water pump or the like in which the disadvantages of the know pumps and the like units are reliably avoided and which permits its installation and removal and a replacement of individual components or subassemblies to be performed easily and with a few manual operations, and which is simpler in structure and permits various pump components to be combined and has a higher efficiency.

This is accomplished in accordance with the invention in that a pump holder is provided and adapted to hold an inserted pump block comprising a pump impeller, pump shaft, pump mount and pump seals and a locking ring.

The pump holder is desirably integrated in the pump housing.

The pump holder is desirably integrated in the cover of a pump housing. The pump holder is desirably integrated in the engine block.

The pump housing desirably consists of a housing body and a housing cover and the housing body and the housing cover may selectively consist each of one or more parts.

The pump housing is desirably provided with a flanged port for connection to the engine block, cooling water ports and a thermostat port. The elements of the pump desirably consist in part of plastic and in part of metal.

The pump block is desirably coupled to the pump holder by a quick coupling.

Quick couplings are desirably provided between the pump housing, on the one hand, and the thermostat, engine block, cooling water lines etc.

The quick couplings are desirably integrated in the pump housing.

A quick coupling which is self-holding in the sense of rotation of the driving disc of the pump is desirably disposed between the pump block and the pump holder.

The quick coupling desirably consists of a bayonet coupling.

The pump block is desirably locked by a locking ring against a reverse rotation when the quick coupling has snapped in.

The locking ring desirably comprises snap lips and movable locking members.

In a desirable embodiment the locking ring is axially guided on the pump mount in guiding grooves and adapted to snap into locked and unlocked positions.

The torque which is exerted by the drive belt and acts through the shaft on the pump mount is desirably taken up by an axially offset multiple bearing arrangement.

The pump mount is desirably adapted to be combined with different pump housings.

The pump mount desirably comprises sealing elements in contact with the drive shaft and the pump holder and bearings for mounting the shaft.

A radially acting seal is desirably provided between the pump mount and the pump holder.

The pump impeller desirably consists of plastic.

The housing cover desirably consists of plastic.

The pump housing desirably consists of plastic.

The pump mount desirably consists of plastic.

Sealing rings are desirably provided as sealing means.

Polyamide is desirably used as a material for the pump mount, the housing cover, the pump housing, the impeller and their components.

A polyethersulfone is desirably used as a material for the components of the pump.

A polyetherketone is desirably used as a material for the components of the pump.

Various advantages are afforded in combination by the water pump in accordance with the invention. The pump is lighter in weight and not susceptible to corrosion. It has a higher efficiency and a higher economy. The functional elements and the components of the water pump can simply be installed and replaced.

Because the water pump which constitutes a functional unit is divided into separable parts, such as the pump block including a pump mount, drive shaft, mount for sealing elements, and pump impeller, on the one hand, and the pump holder, which is integrated in the pump housing, housing cover and engine block, on the other hand, any defective parts can easily be replaced. This permits also a combination, e.g., of the pump block with different housings and vice versa. Similar remarks are applicable to the selection of the materials. For instance, the housing cover may consist of metal and the pump block may consist of plastic. The installation and removal are also facilitated by the provision of quick couplings rather than screws for interconnecting the components of the water pump and for connecting the water pump as a whole to the engine block and to other parts, such as a thermostat, a water supply, etc. The pump block, housing cover and pump housing may be made of plastic, such as polyamide, polyethersulfone or polyetherketone, so that the use of plastic will permit a smoother surface to be provided without a need for machining. As a result, the economy will be improved and the liquid friction within the unit will be reduced, so that the efficiency of the water pump will be improved by 3 to 5%. A further modification in structure resides in the use of self-lubricating plastics also for bearings. In that case the seals may be disposed, e.g., outside the bearing.

The invention will be explained more in detail hereinafter with reference to an illustrative embodiment shown in the drawings.

Figure 1:
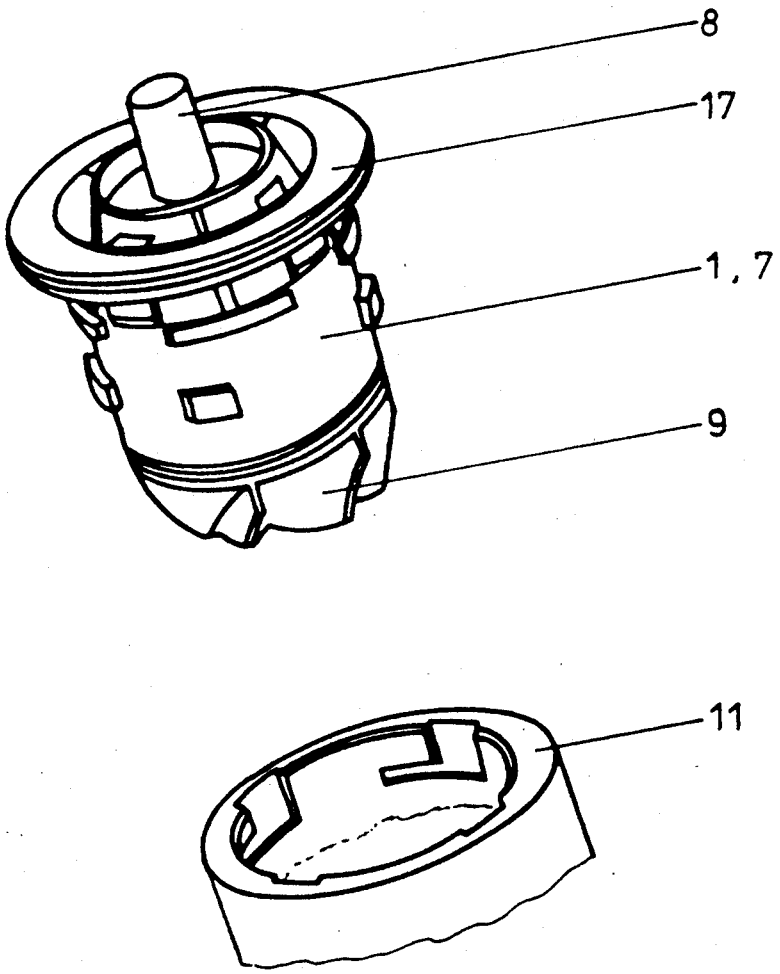
FIG. 1 is a perspective view showing the water pump.

FIG. 1 is an exploded view showing the pump block 1 and the pump holder 11. The pump block 1 essentially consists of the pump mount 7, the driving shaft 8, the pump impeller 9 and the locking ring 17.

Figure 2:
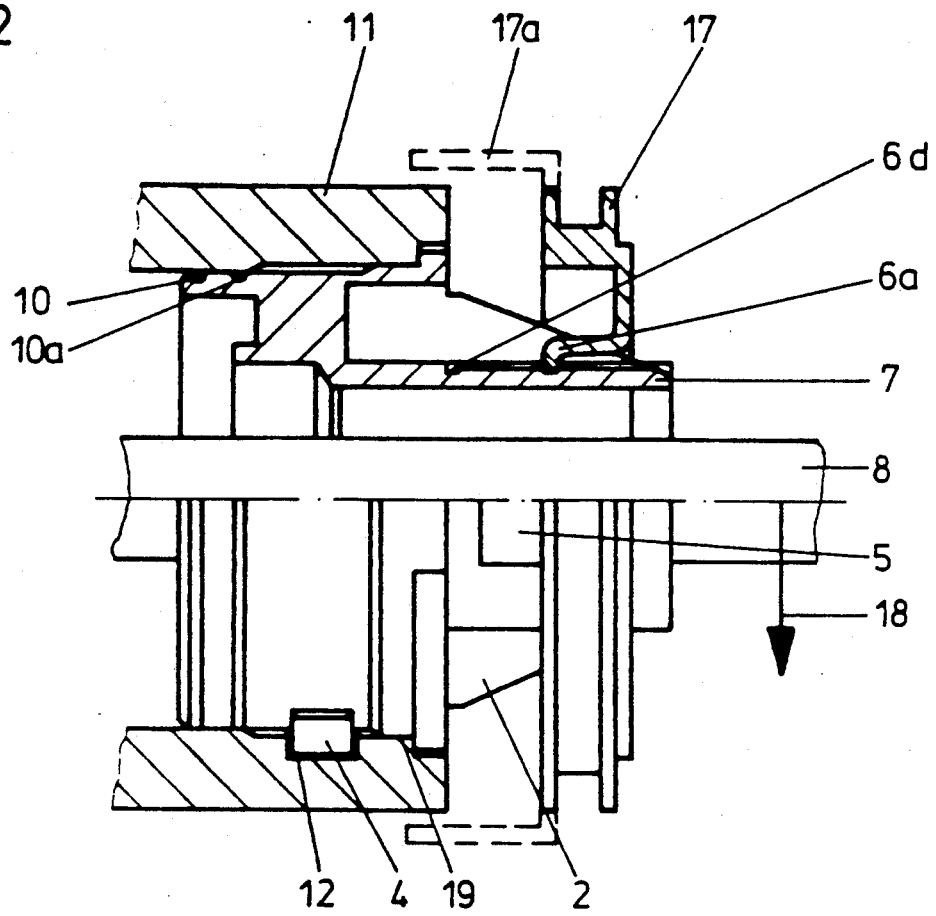
FIG. 2 is a fragmentary sectional view showing the pump block before it has been locked to the pump holder.

FIG. 2 shows the pump block 1 as it is inserted into the pump holder 11. There is still a gap between the rim of the locking ring 17 and the top rim of the pump holder 11. The projections 4 for locking the pump block 1 in the pump holder 11 have already been inserted into the entrances of the recesses 12. The locking ring 17 may be provided with a cover **17*a*, which acts to prevent an ingress of dirt into the pump block. A locking member 17*b* is mounted on the locking ring 17 and when the locking ring 17 has been inserted from the "open" position to the "closed" position (see FIG. 3) prevents a rotation of the pump block 1 relative to the pump holder 11 and thus prevents the pump block 1 from falling out of the pump holder. The locking ring 17 is held in each of said two positions by a snap action of snap lips 17*c* in a guiding groove 5. The pump mount 7 is sealed against the housing cover 11*a* in the pump holder 11 by one or more sealing rings 10 and 10*a***.

A plurality of projections 4 are provided on the outside peripheral surface of the pump mount 7 and are inserted into the entrances of the recesses 12 of the pump holder 11. Said projections are locked in the pump holder 11 when the pump mount 7 has been rotated. One or more seals 10 and/or **10*a* provide a seal between the pump mount 7 and the pump holder 11. Stiffening ribs 2 provided on the pump mount 7 impart the required strength to the pump block 1 in operating condition. A stop rim 3 is provided in the upper portion of the pump mount 7 and serves as a stop cooperating with the pump holder 11. Various ports are provided in the pump housing 13 and include a flanged port 14 for connection to the engine block, cooling water ports 15 and 15*a*, and a flanged port 16 for connection to the thermostat. Said flanged ports may consist of quick couplings which are identical to the quick coupling connecting the pump block 1 to the pump holder 11**.

Figure 3:
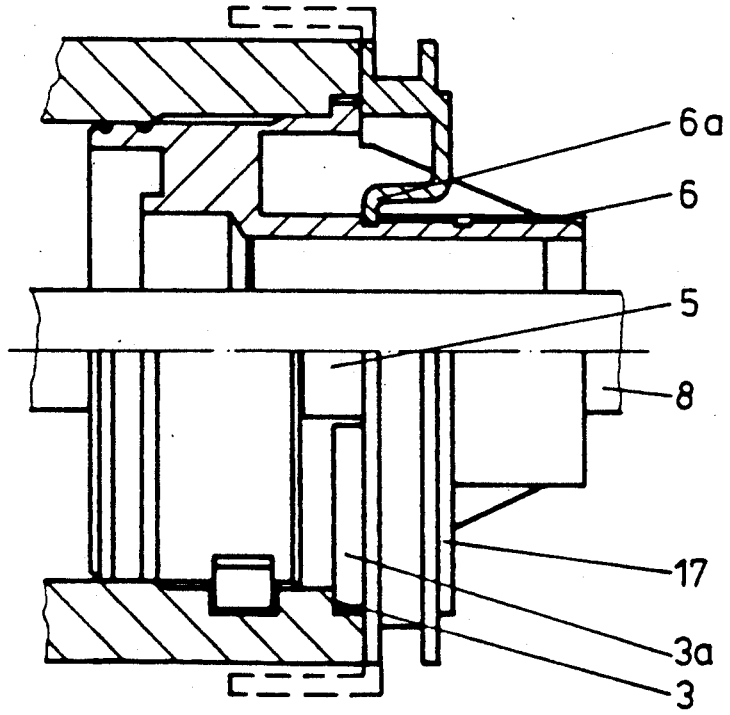
FIG. 3 is a fragmentary sectional view showing the pump block which has been locked to the pump holder.

FIG. 3 shows the pump block 1 which has been inserted and locked in the pump holder 11. It is clearly apparent that the pump block has been inserted until its stop rim **3*a* engages the stop rim 3 in the pump holder 11 and the locking projections 4 have snapped into the locking recesses 12. The snap lip 17*c* sliding in the guide groove 5 has snapped into the undercut recess of that groove and the locking ring 17 covers the end face of the pump holder 11 and the stop rim 3*a* of the pump mount 7. The torque 18 exerted by the drive belt is taken up by the dual bearing arrangement in the regions 10 and 19**.

Figure 4:
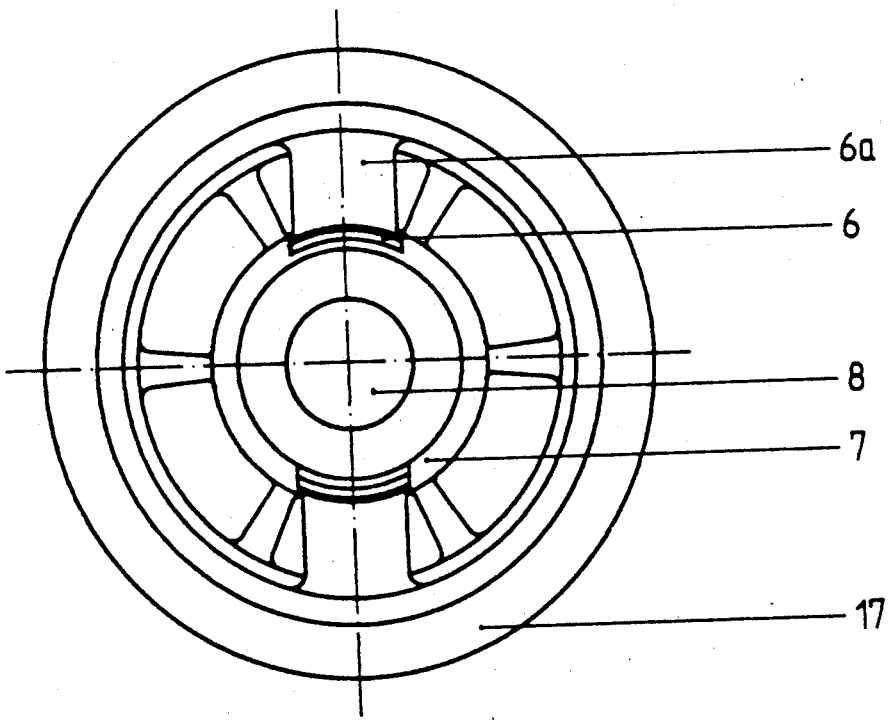
FIG. 4 is a top plan view showing the pump block provided with a locking ring.

FIG. 4 is a top plan view showing the pump block 1. The locking ring 17 provided with the snap lip **17*c* is distinctly apparent as well as the guiding groove 5 in the pump mount 7**.

Figure 5:
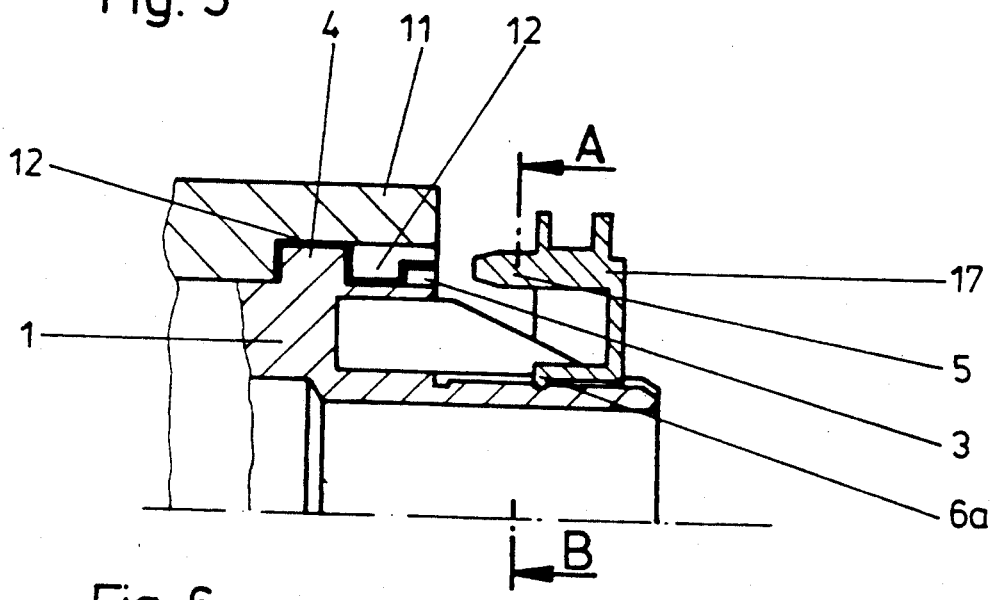
FIG. 5 is a fragmentary sectional view showing the rotation-preventing means releasably locked in an "open" position.
Figure 6:
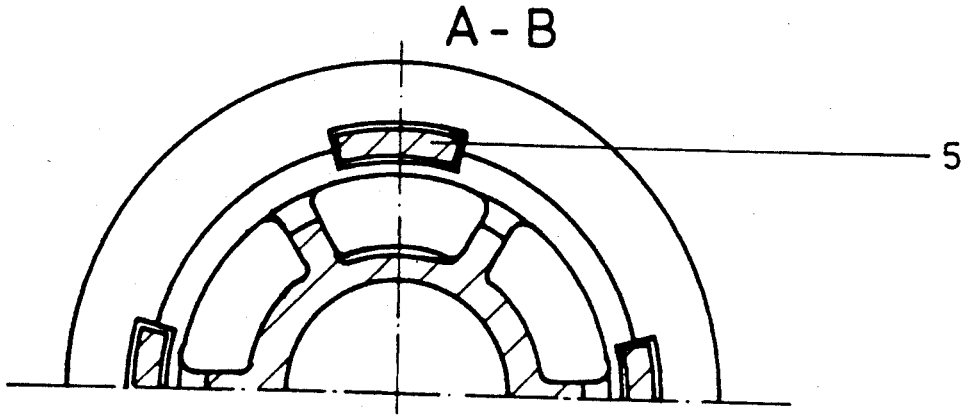
FIG. 6 is a sectional view taken along line A-B of FIG. 5 in the direction indicated by the arrows.

FIGS. 5 and 6 show the means for preventing a rotation of the pump block 1 relative to the pump holder 11. When the locking ring 17 has been axially moved against the pump holder 11, the locking member **17*b* provided on the locking ring 17 will slip into the recess 12 and will thus prevent a rotation between the stop rim 3 of the pump mount 7 and the pump holder 11**.

Figure 7:
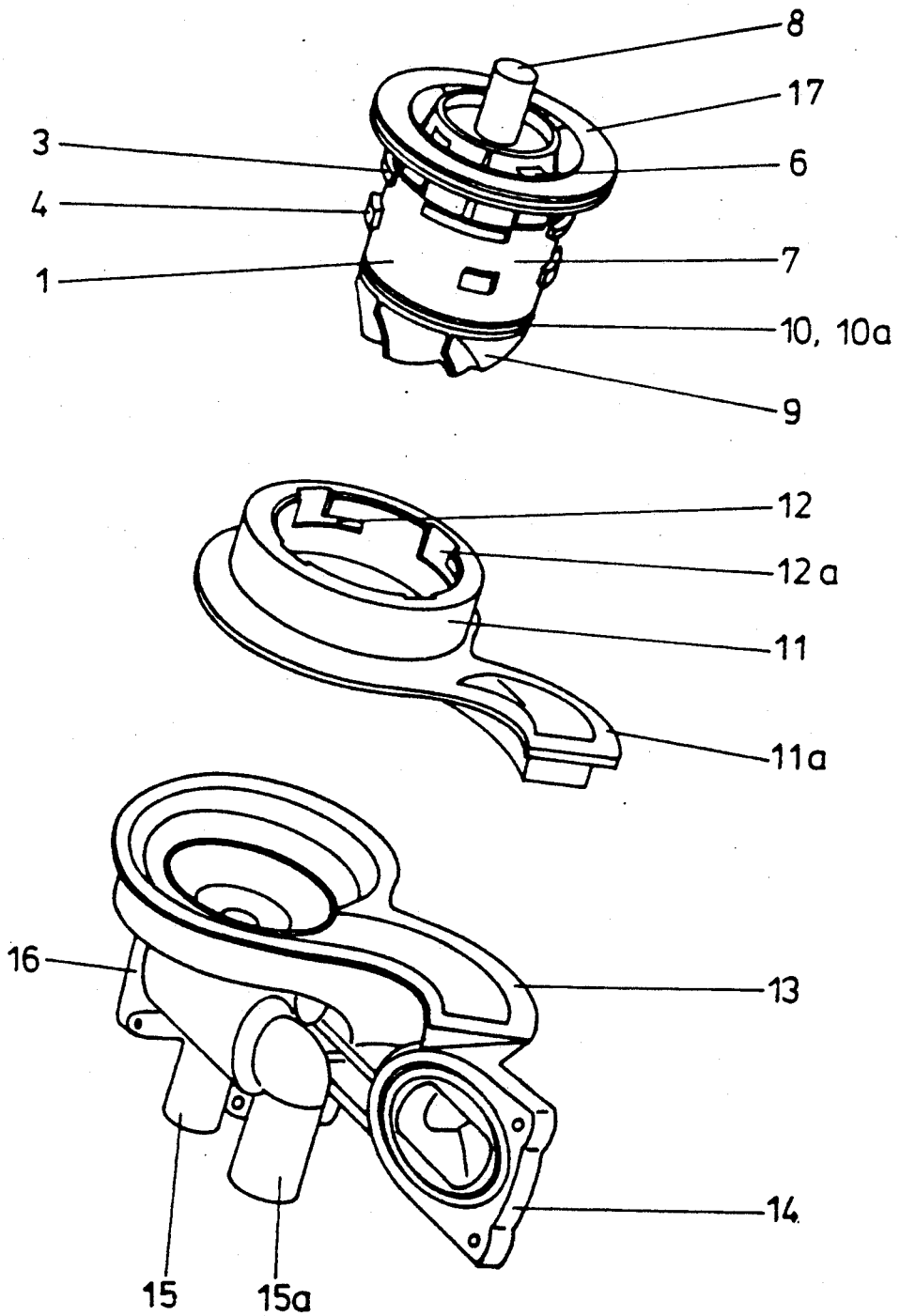
FIG. 7 is a perspective view showing a water pump comprising a pump block, pump housing and housing cover with pump holder.

FIG. 7 is an exploded view showing by way of example a water pump comprising a pump block 1, a housing cover **11*a* provided with a pump holder 11 and a pump housing 13 provided with a thermostat port 16, water ports 15 and 15*a*, and a flanged port 14 for connection to the engine block. The pump housing 13 and the housing cover 11*a* provided with the pump holder 11 may constitute a unit and the pump holder 11** may be integrated in the engine block.

I claim:

1. A water pump for an internal combustion engine comprising: a pump holder and a pump block; said pump block being adapted to fit within said pump holder and including a pump mount; said pump block further including a pump impeller and a pump shaft extending through said pump mount and connected to said impeller in a driving relationship, means on said pump mount including a quick release coupling for mounting said block to said holder, means for sealing said pump mount to said holder, and a snap fit locking ring for locking said block to said holder and to prevent rotation of said block relative to said holder.

2. The invention in accordance with claim 1 wherein said quick release couplings comprise bayonet couplings.

3. The invention in accordance with claim 2 wherein said locking ring includes detents about the periphery thereof and said holder includes recesses configured to receive said detents whereby to enable said ring to be snap locked into position.

* * * * *